US005105119A

United States Patent [19]

Dayton

[11] Patent Number: 5,105,119

[45] Date of Patent: Apr. 14, 1992

[54] ELECTRIC LAMP HAVING A PRESSURE MOLDED BASE

[75] Inventor: David R. Dayton, Stuart, Fla.

[73] Assignee: North American Philips Corporation, New York, N.Y.

[21] Appl. No.: 587,314

[22] Filed: Sep. 21, 1990

[51] Int. Cl.[5] ..... H01J 5/48

[52] U.S. Cl. ..... 313/318; 445/22

[58] Field of Search ..... 313/318; 445/22; 439/611, 612, 617, 619, 736; 362/267

[56] References Cited

U.S. PATENT DOCUMENTS

| | | | |
|---|---|---|---|
| 3,413,511 | 11/1968 | Plagge | 313/318 |
| 4,547,838 | 10/1985 | Wakimizu | 313/318 |
| 4,570,104 | 2/1986 | Janssen | 313/318 |
| 4,864,184 | 9/1989 | Flemming | 313/318 |
| 4,970,428 | 11/1990 | Hayakawa | 313/318 |

FOREIGN PATENT DOCUMENTS 2056041A 3/1981 United Kingdom .

*Primary Examiner*—Donald J. Yusko
*Assistant Examiner*—N. D. Pate
*Attorney, Agent, or Firm*—Brian J. Wieghaus

[57] ABSTRACT

An electric lamp having a light transmissive envelope enclosing a light source, a circumferential mold-sealing member disposed on an end portion of said envelope, and a lamp base of synthetic material pressure molded onto the mold-sealing member and the envelope end portion. The mold-sealing member provides an effective seal with the corresponding edge of a base mold, allowing the base to be molded directly onto the lamp envelope. For envelopes sealed by a pinch or wedge press, the mold-sealing member is a circumferential ring and for stem-sealed lamps the mold-sealing member is a sealing cap which closes the stem cavity.

22 Claims, 4 Drawing Sheets

ELECTRIC LAMP HAVING A PRESSURE MOLDED BASE

BACKGROUND OF THE INVENTION

1) Field of The Invention

The invention relates to electric lamps and, more particularly, to the manufacture and assembly of lamp bases onto lamp envelopes.

2) Description of the Prior Art

Electric lamps typically have lamp bases or caps Which are manufactured separately from the lamp and are secured to the lamp envelope after sealing of the envelope in a gas-tight manner. The bases are secured to the lamp envelope using a basing cement and/or by a mechanical locking between the lamp cap and the lamp envelope. The separate manufacture and fixation of lamp bases to lamp envelopes inevitably results in breakage and/or loss of bases and the resulting costs associated therewith.

Examples of lamps having cemented bases include General Lighting Service (GLS) incandescent lamps having Edison screw bases, and S-8 type automotive lamps having bayonet bases. In these lamps, the base is fixed to the lamp envelope using a phenolic resin cement. A disadvantage of using cement is that special handling is often required for the cement, for example, to control its temperature and moisture content, and the cement must be cured during lamp manufacture, all of which may add significantly to lamp processing time and cost. For some cements, the curing time may be lessened by the application of heat, but this also adds to the expense of the lamp.

In addition to the processing disadvantages, the bonding between the lamp cap and the envelope has often been found to be less than satisfactory. Some basing cements are adversely effected by high humidity during curing and in storage or service. Moisture absorbed into the cement may reduce the strength of the cement bond and the effectiveness of the seal between the lamp cap and the lamp envelope. The weakened bond poses a hazard to users of the lamp because upon attempted removal of the lamp from its socket, the lamp bulb may separated from the cap, possibly breaking the bulb, and leaving the cap in the socket rendering its removal difficult, if not hazardous. Additionally, for lamps exposed to the environment, such as S-8 automotive lamps having a brass bayonet base, the cement provides an ineffective seal, allowing moisture, dust, and dirt to infiltrate between the brass base and the envelope, causing corrosion of the lead-wires and the base.

Lamps having mechanically secured lamp bases typically have discontinuities such as ridges or channels in the neck, stem, or pinch seal area, lockingly engaged by corresponding discontinuities on the lamp cap. For example, U.S. Pat. No. 4,849,670 and U.S. Pat. No. 4,146,814 show a one and two-piece metallic lamp cap for a single-ended miniature incandescent lamp having tangs or corrugated projections which extend in axial grooves in the pinch seal. Generally, to ensure correct positioning and a strong fixation, the dimensions of the mating parts of the lamp envelope and base must be tightly controlled. Additionally, multi-piece lamp caps of synthetic material are known which snap together and lock on the lamp envelope. In addition to possible integrity problems with the extra connection between the parts, this type of base adds to the number of parts which must assembled.

In recent years, the use of lamp bases or caps of synthetic material, especially in automotive lamps, has become more common. Such lamp caps typically have pin or tongue-shaped contacts fixed therein or use the lamp lead-throughs as contacts. Lamp caps of synthetic material are generally manufactured by injection molding and are later fixed to the lamp envelope either by cement or by mechanical fixation, and suffer from the same lamp manufacturing disadvantages as discussed above with respect to metallic bases. For example, U.S. Pat. No. 4,864,185 shows an S-8 type automotive lamp having a lamp cap of synthetic material which is secured to the lamp envelope by an epoxy cement.

Despite the use of synthetic material for the lamp cap, protection of the lamp lead-ins from moisture and dirt remains a problem in many lamps. In U.S. Pat. No. 4,687,965, a type 9005/9006 automotive head lamp having a lamp cap of synthetic material is shown. The lead-ins pass through aperture in an end wall of a dish-shaped part and are welded to the ends of tongue-shaped contact terminals. A synthetic foam material or RTV silicone rubber is required in these lamps to protect the welded connection between the terminals and the lead, and to prevent moisture and dirt from infiltrating through the apertures in the end wall. In the above mentioned U.S. Pat. No. 4,864,185 the leads are passed through channels in the lamp cap through which moisture, dust, and dirt may infiltrate if an effective seal is not maintained between the lamp cap and its socket.

Other lamps having bases of synthetic material include compact low pressure mercury vapor discharge lamps in which the adjacent ends of an elongate discharge tube are supported in a mounting plate or base member of a lamp bowl or shell. For example, U.S. Pat. No. 4,853,583 shows a PL* type compact fluorescent lamp having the adjacent ends of the discharge tube fixed by cement in a metallic base portion which is secured to a lamp shell, holding the starter, by rivets. U.S. Pat. Nos. 4,375,607 and 4,503,360 show SL* type compact fluorescent lamps having a bowl-shaped shell in which the adjacent ends of the discharge tube are secured in a mounting plate or base member of the shell by cement.

Accordingly, it is an object of the invention to provide an electric lamp having improved fixation of the lamp base, or base portion, to the lamp envelope.

Another object of the invention is to provide a lamp having a base with a cementless connection to the lamp envelope.

Another object of the invention is to provide an electric lamp having a lamp base which can be provided on the lamp envelope at reduced cost to bases known in the art.

Yet another object of the invention is to provide an electric lamp having a lamp base which can be formed directly on the lamp envelope.

Still another object of the invention to provide an electric lamp having improved sealing of the lamp base to the envelope and protection of the lamp leads.

SUMMARY OF THE INVENTION

The lamp according to the invention has a light transmissive lamp envelope, a light source disposed therein, and a base portion of synthetic material pressure molded on an end portion of the lamp envelope. A mold-sealing member having a peripheral sealing surface effective for sealing a corresponding edge of a pressure mold is circumferentially disposed on the envelope end portion. As used hereinafter "pressure molded" refers to bases manufactured by forming a synthetic material under pressure in a mold, and includes without limitation, compression molding, transfer molding, injection molding, and insert molding.

In lamps without a mold-sealing member, it was found that bases, or parts thereof, could not be reliably pressure molded onto the lamp envelope, for example by injection molding, because surface variations between lamp envelopes allowed synthetic material to flow out from between the edge of the injection mold and the envelope, resulting in faulty bases. The dimensions of the mold-sealing member according to the invention may be more readily controlled than a glass lamp envelope and provides an effective sealing surface for the corresponding edges of the mating parts of a mold. With a mold-sealing member of resilient synthetic material, an effective seal is readily obtained with a metallic edge of a mold. The mold-sealing member also prevents scratching of the lamp envelope by the mold, which can lead to subsequent failure of the envelope when thermally stressed. For a given lamp, the mold-sealing member may be provided on existing lamp envelopes without the need to change or alter the envelope production.

According to an embodiment of the invention, the mold-sealing member is annular and has an inner surface resiliently engaging the lamp envelope and forming a seal therewith. Preferably, the annular sealing member is spaced from the end of the envelope adjacent the forward edge of the lamp cap or base. The annular sealing member has the advantage that it may be easily assembled onto the pinch seal or neck portion of an envelope.

The annular sealing member may be a ring of synthetic material, which has been found to be especially effective for lamps having a pinch or press seal. The sealing ring is preferably spaced from the envelope end, positioned at the end of the lamp base on the envelope furthest from the adjacent envelope end. Thus only one circumferential edge of the mating mold parts need to be sealed to the sealing member of the lamp envelope. The mold edges at the opposite end of the mold parts may then be spaced from the end of the envelope, and seal with each other in a conventional fashion rather than with another mold-sealing member on the envelope. The ring-shaped sealing member prevents the viscous synthetic material, under pressure in the mold during molding, from passing between the lamp envelope and the inner surface of the sealing member and from between the mold edges and the sealing member. The sealing member has been found to be especially effective for sealing the mold halves of an injection mold, which are closed in the sealing member prior to injection of the synthetic material under pressure into the mold. In the resulting lamp, the lamp base or base portion extends in contact with the lamp envelope from the end of the lamp envelope up to the sealing member and terminates on the sealing member.

Additionally, since the press seal is solid and not readily susceptible to cracking under compression, the pressure of the synthetic material during cooling in the mold results in residual stresses in the hardened base material which effectively lock the sealing ring and the base to the lamp envelope. The residual stresses can be controlled by controlling the amount of synthetic material introduced into the mold or by the pressure with which it is injected.

However, for lamps having lamp envelopes sealed by a reentrant stem, for example S-8 automotive lamps and tubular fluorescent lamps, it was found that the force of the synthetic material on the stem during pressure molding of the base, even at the lowest practical pressures, caused the lamp stem to fail in tension, destroying the envelope. To overcome this problem, a sealing member according to another embodiment of the invention closes the cavity between the stem and the end of the lamp envelope and prevents the synthetic material from flowing into the stem cavity. Preferably, the sealing member is cup-shaped, having a circumferential body receiving the end or neck portion of the envelope and an integral end wall closing the stem cavity. The lamp lead-throughs extend in a sealed manner through apertures in the end wall to prevent flow of the viscous synthetic material into the cavity during pressure molding. The cup-shaped sealing member has a simple shape which is easy to manufacture and assemble on the lamp envelope and has been found to be especially effective for manufacturing bases by injection molding.

The sealing member is preferably sized such that it is secured on the lamp envelope by friction prior to injection molding of the base onto the envelope. However, according to another embodiment of the invention, increased fixation of the sealing member is achieved by one or more discontinuities, for example dimples or ribs, which further secure the sealing member.

Additionally, the envelope end portion and/or the sealing member may also be provided with discontinuities into or around which the synthetic base material flows during injection molding. After cooling, the hardened synthetic base material engaging the discontinuities locks the base to the sealing member/end portion respectively. The tolerances for the discontinuities are not critical because the molten synthetic material flows into or around the discontinuities during molding.

According to the invention, the pressure molded portion may form only part of the lamp base. For example, the injection molded part may be the wall of a lamp shell for a compact fluorescent lamp which supports the discharge vessel. This wall may then be connected to other parts of the shell in a conventional manner.

However, it is particularly advantageous to pressure mold a complete base onto the lamp envelope, rather than only a portion thereof, as this yields an extremely rugged lamp. Preferably, the conductive contacts are integrally molded in the lamp base, which simplifies manufacturing, provides effective fixation of the contacts in the base, and provides a hermetic seal preventing corrosion of the lead wires. It is especially attractive to injection mold the bases onto the lamp envelope because injection molding is readily automated and permits adequate control of the temperature and injection pressure of the synthetic plastic material into the mold.

The sealing member is preferably a molded part of synthetic material to facilitate cost effective manufacture. Suitable synthetic materials for the sealing member include nylon, and thermo-setting synthetic materials.

DESCRIPTION OF THE PREFERRED EMBODIMENTS

Figure 1:
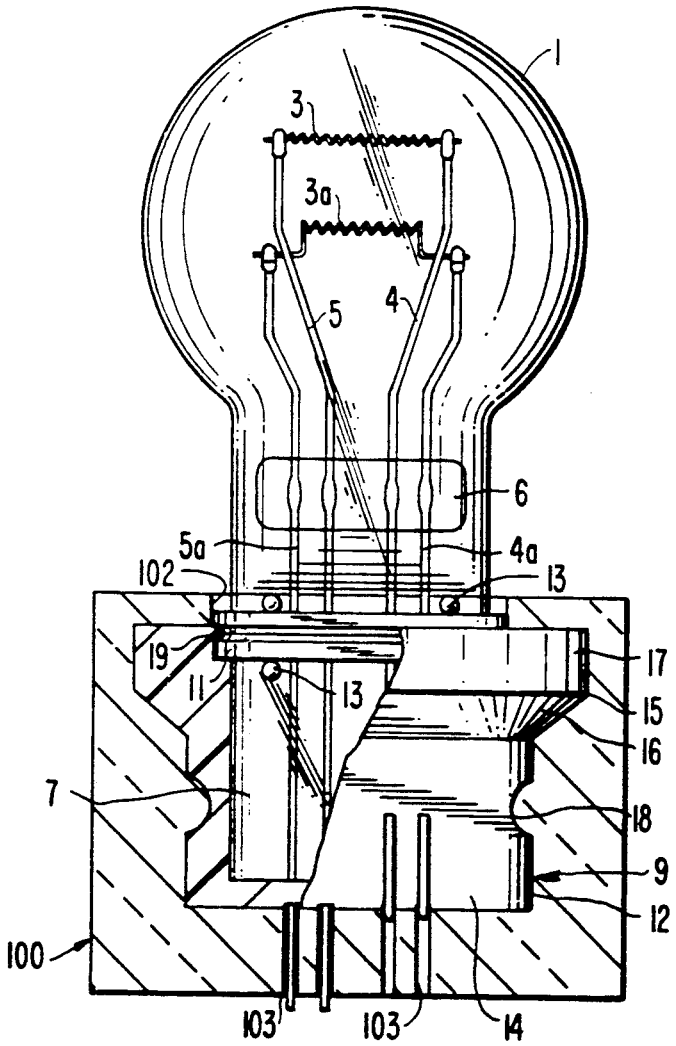
FIG. 1 shows an incandescent lamp, partly in section, having a press seal, an annular sealing member, and a pressure molded base.

FIG. 1 shows an electric incandescent lamp having a light transmissive envelope 1 in which a light source consisting of filaments 3, 3a are supported by conductive leads 4, 4a and 5, 5a. The envelope 1 is sealed by pinch, or press, seal 7 through which the conductive leads extend in a gas-tight manner, as is conventional. Bridge 6 of quartz glass provides additional support for the conductive leads.

The lamp base 9 consists of synthetic material and is injection molded onto the pinch seal 7 and the sealing member 11. The conductive leads extend from the end of the pinch through the synthetic base and emerge from the bottom (not shown) of lead-support portion 12. The leads, of for example nickel-iron or dumet, are hermetically sealed in the base by reason of being molded therein. The leads extend from the bottom of the lead-support portion 12 along respective flat faces 14 of the lead support portion Selective application of a potential across respective pairs of leads 5, 5a and 4, 4a allows a current to flow through the filaments to emit light. The base 9 has a flange portion 15 having a bevelled frustrum 16 and rim 17. The lead-support portion 12 has a notch 18 engageable by a pair of resilient locating lugs of a socket, not shown, to secure the base in the socket.

The base may be injection molded onto the pinch 7 by reason of annular mold-sealing member 11, which consists of a synthetic material. Sealing member 11 is generally rectangular, having a central aperture for receiving the pinch seal 7, a circumferential groove 19 and a flat peripheral rim 20. The inner surface of the aperture is sized such that it has a friction fit with the surface of the pinch seal.

Prior to injection molding of the base, the sealing ring 11 is slid onto the pinch seal and is positioned on the pinch by discontinuities, such as circular protrusions 13. Alternatively, the sealing member may be secured to the pinch seal by a friction fit alone. To form the lamp base, the lamp having the sealing member thereon is positioned within a suitable mold. For the purpose of illustration, FIG. 1 shows a mold half 100 having a sealing surface 102 against which the rim 20 rests and channels 103 in which the conductive leads 5, 5a rest. The leads 4, 4a are shown bent along the lead-support as in the finished base, but during molding of the base would extend in grooves 103 in the same manner as leads 5, 5a. To mold the base, a mating mold half, not shown, is closed on the mold half 100. The sealing surfaces 102 of the two mold parts form a seal with the rim 20 of the sealing ring 11. The channels 103 are sized to form a seal with the lamp leads 4, 4a and 5, 5a. Molten synthetic base material is then injected under pressure into the mold through conventional conduits or nozzles, not shown, to fill the mold space. The synthetic material flows into the groove 19 of the sealing member. After cooling and hardening of the synthetic base material, the base is fixed to the sealing member by reason of the material which has hardened in the groove 19 and to the pinch seal by reason of being molded thereon. Residual stresses in the base also bias the sealing member against the envelope to lock it thereon. After ejection from the mold by conventional ejection pins, the leads 4, 4a and 5, 5a are bent along the flat faces 14 of the lead-support 12 and are partially enclosed in suitable grooves, not shown.

The synthetic resin material for the base may be any suitable thermo or thermo-setting plastic such as nylon, Lexan, phenolics, Ultem, etc. which may be injection molded and which have sufficient strength and heat resistance characteristics for the lamp to which it is molded. The material for the sealing member may likewise be a thermo or thermo-setting plastic. In the lamp shown in FIG. 1, the sealing ring 11 was glass-filled nylon.

The pinch seal and sealing member 11 need not have grooves or protrusions for which the molten base material may flow into or around. Sufficient fixation of the base and sealing member to each other and to the pinch seal may be obtained by the residual stress of the synthetic material in the base on the sealing member. This locking stress can be controlled by controlling the pressure of the synthetic material in the mold during molding.

Figure 2:
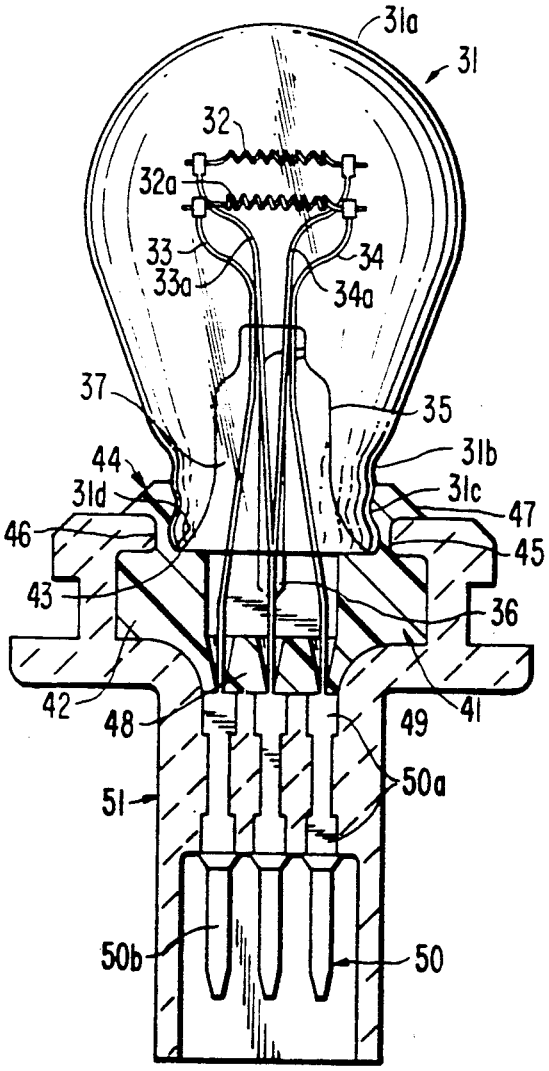
FIG. 2 shows an incandescent lamp sealed by a reentrant stem and having a sealing cap and injection molded base according to the invention.

FIG. 2 shows a stem-sealed incandescent lamp according to another embodiment of the invention. The glass envelope or bulb 31 has a bulbous portion 31a and a reentrant stem 35 sealing the neck portion 31b in a gas-tight manner. Filaments 32 and 32a are supported by conductive nickel, nickel plated dumet, or alloy 52 (NiFe) leads 33, 33a, 34, and 34a, respectively. The reentrant stem defines a cavity 37 between the reentrant stem and the end of the envelope 31d. The nylon mold sealing member 41 has a body 42 having a shoulder 43 which butts against the envelope end 31d. Collar 44 of the mold sealing member has a narrow neck 45, formed by circumferential groove 46, and a bevelled sealing surface 47. The collar 44 has slits 44S spaced around the circumference thereof forming a collet to allow compression of the collar 44 onto the neck. The sealing cap has an end wall 48 having tapered channels 49 through which the conductive leads extend. When the sealing cap is assembled on the lamp envelope, prior to injection molding, the leads are passed through the channels 49 and the sealing cap 41 is secured on the envelope by reason of collar 44 snapping past circumferential ridge 31c of the lamp envelope. The channels 49 are sized such that they form a seal with the leads to prevent molten plastic from flowing through the channels and into the cavity 37 during injection molding. The contact terminals 50 are fixed to the corresponding leads prior to molding of the base by welding, crimping, or staking.

As in FIG. 1, the lamp envelope is positioned in a suitable mold with the bevelled sealing surface 47 of the sealing cap biased between the corresponding sealing edge of the mold parts and with the terminal ends 50b resting in suitable sealing channels of the mold. The sealing cap may be positioned in the mold, for example, with the aid of one or more blind holes engaged by corresponding pins of the mold. During injection of the plastic material, the plastic material fills the mold cavities and flows around the terminals 50. However, the molten plastic under pressure is prevented from flowing into cavity 37 and contacting stem 38 by reason of end wall 48 and sealed channels 49 and from flowing into the ends 50b of the contact terminal by reason of corresponding sealing channels in the mold. The base 51 is locked on the sealing cap 41 by the material which flows into the groove 46 and the sealing cap is further secured on the envelope by the residual force exerted by the plastics material which biases the colletted collar against the envelope adjacent ridge 31*c*. The terminals 50 are secured and hermetically sealed in the base by reason of being molded therein. The injection molded base is extremely rugged and corrosion resistant.

Figure 3:
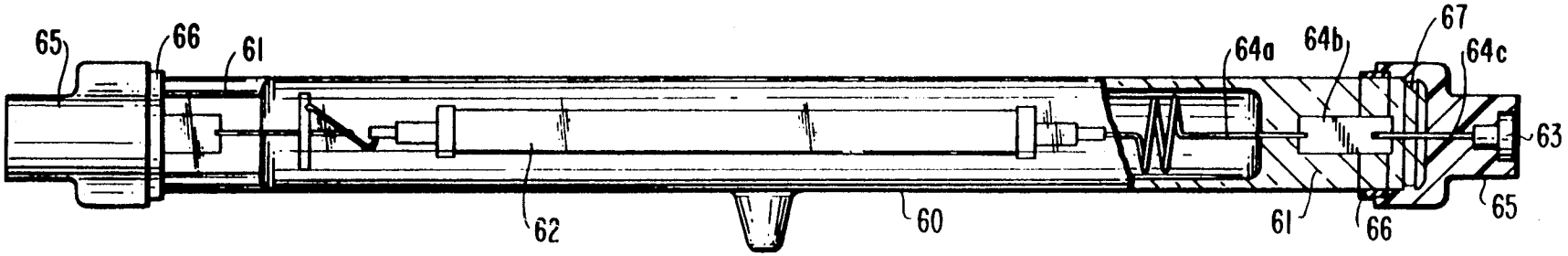
FIG. 3 shows a double-ended high pressure sodium discharge lamp having an injection molded base.

FIG. 3 shows a tubular double-ended high pressure sodium discharge lamp having a tubular glass outer lamp envelope 60 sealed at each end by pinch seals 61. Arc tube 62 is connected in a conventional manner to conductive contacts 63 in bases 65 at each end of the envelope via current conductors 64*a*, 64*c* and molybdenum foil 64*b* in a conventional manner. The lamp bases 65 consist of a thermosetting plastic and are injection molded onto the sealing ring 66 and the pinch seal 61. The contact 61 and conductor 64*c* are molded in the lamp base. The fixation of the base 65 to the pinch seals 61 is enhanced by reason of the synthetic material which flows into transverse grooves 67 on the surface of the pinch seals, and hardens therein upon cooling to lock the bases thereto.

Figure 4:
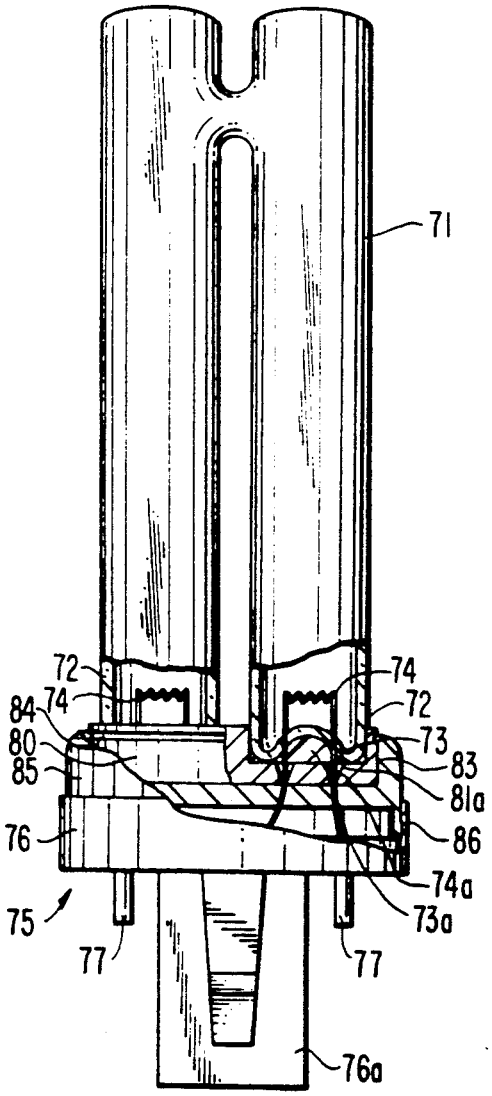
FIG. 4 shows a compact fluorescent lamp with a lamp shell having a base wall molded onto a sealing member according to the invention.

FIG. 4 shows a compact low-pressure mercury vapor discharge lamp having a discharge vessel 71 having juxtaposed ends 72 sealed in a gas tight manner by respective reentrant stems 73 carrying discharge electrodes 74. A light source is comprised of the electrodes, the discharge vessel being filled with mercury and a rare gas, and a luminescent layer 70 in the inner wall of the discharge vessel. A U-shaped discharge is maintained during lamp operation between electrodes 74 and the luminescent layer converts radiation generated in the discharge into visible light. The lamp base 75 consists of a shell 76 carrying contact pins 77 and a base portion 85. A rectangular tubular portion 76*a* extends between the pins and encloses a conventional glow starter and starting capacitor, not shown. The base portion 85 consists of synthetic material injection molded onto a sealing cap 80. The sealing cap has an oval shaped base wall 81 closing cavity 73*a* and an oval-shaped wall portion 82 having a pair of circular apertures each receiving a respective end 72 of the discharge vessel. Edge portion 83 is engaged by the corresponding edge of a mold during injection molding of the base. Molten plastic material flows into groove 84 locking the finished base to the sealing cap. Conductive leads 74*a* extend through channels 81*a* preventing molten plastic material from contacting the stem 73. The base portion 85 is secured to the shell 75, for example, by snap connections 86.

While there has been shown to be what are presently considered to be the preferred embodiments of the invention, it will be apparent to those of ordinary skill in the art that various changes and modifications can be made to the lamp bases and sealing member without departing from the scope of the invention as defined by the appended claims. Those of ordinary skill in the art will appreciate that the geometry and materials of the sealing member and bases are limited only by molding technology and that the embodiments shown are illustrative and not limiting. For example, the bases may be formed by insert molding in which subparts of the base are placed in the mold and synthetic material is forced under pressure around the subparts in the mold forming an integral unit.

What is claimed is:

1. An electric lamp comprising a light transmissive envelope having an end portion terminating at an envelope end a light source disposed within said envelope energizable for emitting light, and a lamp base secured to said envelope end portion, the improvement comprising:

a mold-sealing member circumferentially disposed on said envelope end portion and having a peripheral surface effective for sealing with the corresponding edge of a pressure mold; and a portion of said lamp base consisting of synthetic material and pressure molded onto said lamp envelope end portion and said mold-sealing member.

2. An electric lamp according to claim 1, wherein said sealing member is annular and has an inner surface resiliently engaging said lamp envelope and forming a seal therewith, said synthetic base material extending in contact with said lamp envelope from said envelope end to said sealing member and extending onto said peripheral surface of said sealing member.

3. An electric lamp according to claim 2, wherein said lamp envelope end portion is a press seal.

4. An electric lamp according to claim 1, wherein said envelope comprises a reentrant stem sealing said envelope in a gas-tight manner, said stem defining a cavity between said stem and said envelope end, and said mold-sealing member closing said cavity.

5. An electric lamp according to claim 4, wherein said mold-sealing member comprises a body closed by an end wall, said envelope end portion being received in said body and butting against said end wall.

6. An electric lamp according to claim 5, further comprising a conductive lead extending from said stem through said end wall of said mold-sealing member in a sealed manner.

7. An electric lamp according to claim 6, wherein said mold-sealing member comprises a collet.

8. An electric lamp according to claim 1, wherein said envelope end portion comprises a discontinuity, said synthetic base material engaging said discontinuity and locking said base portion on said envelope.

9. An electric lamp as claimed in claim 1, wherein said sealing member comprises a discontinuity, said synthetic material engaging said discontinuity and locking said base portion on said sealing member.

10. An electric lamp according to claim 1, wherein a complete said base is injection molded onto said lamp envelope.

11. An electric lamp according to claim 10, further comprising a conductive lead extending from said light source through said envelope and being hermetically sealed in said base.

12. An electric lamp as claimed in claim 11, wherein said base comprises a contact terminal integrally molded therein and connected to said conductive lead.

13. An electric lamp according to claim 1, wherein said mold-sealing member comprises a collet.

14. An electric lamp comprising a light transmissive envelope having a reentrant stem sealing an end of said envelope in a gas-tight manner, said stem defining a cavity between said stem and said envelope end, a light source disposed within said envelope energizable for emitting light, a lamp base secured on said envelope end opposite said reentrant stem and having a conductive contact, and a conductive lead extending from said light source through said stem to said contact, the improvement comprising:

a mold-sealing cap disposed on said envelope end closing said cavity and having a circumferential mold-sealing portion extending on the envelope adjacent said end and effective for sealing with the corresponding edge of a pressure mold, said sealing cap having an aperture through which said conductive lead extends in a sealed manner; and a lamp base portion of synthetic material pressure molded onto said sealing cap, said mold sealing cap closing said cavity and said conductive lead being sealed in said aperture for preventing flow of synthetic material into said reentrant stem during pressure molding, said base portion biasing said sealing cap against said envelope and fixing said sealing cap and said base portion to said envelope.

15. An electric lamp as claimed in claim 14, wherein said envelope has a tubular neck portion adjacent said reentrant stem, and said sealing cap has a body for receiving said neck portion with a friction fit and an integral end wall closing said body and said reentrant stem cavity.

16. An electric lamp according to claim 15, wherein said sealing cap comprises a collet.

17. An electric lamp according to claim 16, wherein a complete said base is injection molded onto said lamp envelope.

18. An electric lamp as claimed in claim 17, wherein said contact terminal is integrally molded in said base.

19. An electric lamp as claimed in claim 14, wherein said lamp is a compact fluorescent lamp having a discharge tube with a sealed end having discharge electrodes, said lamp base comprises a base plate for holding said sealed end and a shell connected to said base plate enclosing a starter for said discharge tube, and said base plate consists of said pressure molded base portion.

20. An electric lamp, comprising:

a) a light transmissive envelope having a sealed end portion terminating at an envelope end;

b) a light source disposed within said envelope and energizable for emitting light;

c) a circumferential body of synthetic material circumferentially disposed on said envelope end portion and having an outer peripheral surface; and d) a lamp base fixed on said envelope end portion and comprises of one of a thermo-plastic and thermosetting plastic base material, said base material circumferentially engaging said outer peripheral surface of said circumferential body and extending axially towards said envelope end, said base material having residual stresses biasing said base against said circumferential body and said circumferential body against said envelope end portion for clamping said base and circumferential body to said end portion.

21. An electric lamp according to claim 20, wherein said sealed envelope end portion is a press seal terminating at said envelope end, said circumferential body is annular and is axially spaced from said envelope end, and said base material extends in contact with said press seal between said annular ring and said envelope end, said residual stresses clamping said base to said press seal.

22. An electric lamp according to claim 20, wherein said sealed envelope end is comprised of a re-entrant stem defining a cavity between said stem and said envelope end, said circumferential body is closed by an end wall, said envelope end portion being received in said circumferential body with said cavity closed by said end wall of said circumferential body, and said base extending axially past said end wall and covering said end wall.

* * * * *